US007797790B2

(12) United States Patent
Park et al.

(10) Patent No.: US 7,797,790 B2
(45) Date of Patent: Sep. 21, 2010

(54) DUST COLLECTOR OF VACUUM CLEANER

(75) Inventors: Tae Jin Park, Gimhae-si (KR); Sang Jun Park, Changwon-si (KR); Kang Won Moon, Changwon-si (KR); Seog Yong Kim, Changwon-si (KR); Jae Duck Jung, Changwon-si (KR); Suck Hyun Moon, Masan-si (KR)

(73) Assignee: LG Electronics Inc., Seoul (KR)

( * ) Notice: Subject to any disclaimer, the term of this patent is extended or adjusted under 35 U.S.C. 154(b) by 1686 days.

(21) Appl. No.: 11/006,572

(22) Filed: Dec. 8, 2004

(65) Prior Publication Data

US 2005/0138759 A1 Jun. 30, 2005

(30) Foreign Application Priority Data

Dec. 27, 2003 (KR) ..... 10-2003-0098396
Dec. 27, 2003 (KR) ..... 10-2003-0098400
Dec. 27, 2003 (KR) ..... 10-2003-0098402
Dec. 27, 2003 (KR) ..... 10-2003-0098403
Dec. 27, 2003 (KR) ..... 10-2003-0098404

(51) Int. Cl.
*A47L 9/10* (2006.01)

(52) U.S. Cl. ..... 15/347; 15/349

(58) Field of Classification Search ..... 15/347, 15/349, 352

See application file for complete search history.

(56) References Cited

U.S. PATENT DOCUMENTS 3,621,640 A * 11/1971 Ohno et al. ..... 55/300
6,536,072 B2 * 3/2003 Thur et al. ..... 15/323
6,818,032 B2 * 11/2004 Bilek et al. ..... 55/337
6,863,702 B2 * 3/2005 Sepke et al. ..... 55/337
7,117,558 B2 * 10/2006 Bair et al. ..... 15/351
2003/0066156 A1 * 4/2003 Yang ..... 15/327.2
2003/0066273 A1 * 4/2003 Choi et al. ..... 55/337

* cited by examiner

*Primary Examiner*—Randall Chin
(74) *Attorney, Agent, or Firm*—KED & Associates, LLP

(57) ABSTRACT

A vacuum cleaner is provided. The vacuum cleaner includes a main body, a suction nozzle coupled to the main body to draw in particle laden air, and a dust collecting assembly detachably coupled to the main body and including a dust collecting container that has a dust collecting space formed therein. Particle laden air is drawn in through a polluted air inlet, and particle free air is discharged through a clean air outlet of the dust collecting container. The main body includes a dust collecting assembly receiving groove that receives the dust collecting assembly, and a clean air inlet is provided on an inner wall of the dust collecting assembly receiving groove, facing the dust collecting assembly. The clean air inlet is in communication with an outlet of the dust collecting assembly through which particle free air is discharged from the dust collecting assembly.

14 Claims, 11 Drawing Sheets

DUST COLLECTOR OF VACUUM CLEANER

CROSS-REFERENCE TO RELATED APPLICATIONS

This application claims the benefits of Korean Application Nos. P2003-98400, P2003-98402, P2003-98403, P2003-98404 and P2003-98396 filed on Dec. 27, 2003, which are hereby incorporated by reference as if fully set forth herein.

BACKGROUND OF THE INVENTION

1. Field of the Invention

The present invention relates to a vacuum cleaner, and more particularly, to a vacuum cleaner with a dust collecting assembly.

2. Discussion of the Related Art

In general, as an apparatus for cleaning a floor or carpet of an interior, a vacuum cleaner sucks in polluted outside air with impurities through operation of an air sucking device such as a motor provided in a main boy thereof, and collects impurities separated from polluted air, and discharges cleaned air to an outside thereof.

Hereinafter, a related art upright type vacuum cleaner will be described referring to FIG. 1. Referring to FIG. 1, the related art vacuum cleaner includes a sucking nozzle 2 moving on a floor and sucking polluted air with impurities, a main body 4 provided at an upper part of the sucking nozzle 2 and having an air sucking device therein for generating air sucking force, and a handle 6 coupled with an upper part of the main body 4.

The sucking nozzle 2, through an inlet provided on a bottom surface thereof, sucks in polluted air with impurities by operating the air sucking device while moving on the floor to be cleaned.

As aforementioned, the main body 4 includes the air sucking device (not shown) generating sucking force, and sucks in polluted air with impurities through the inlet by operating the air sucking device.

The main body 4 is hinge coupled with an upper rear part of the sucking nozzle 2, and the body 4 is provided to be inclined rearward from the sucking nozzle 2 at a predetermined angle.

A handle 6 for a user to operate the movement of the vacuum cleaner is coupled to the upper part of the main body 4, thereby allowing the user to clean a desired area adjusting an inclination angle of the main body 4.

Meanwhile, on a front surface of the main body 4, a dust collecting assembly 8 is detachably provided for collecting impurities separated from the polluted air, and a detachable device 7 is provided at the main body, particularly at an upper part of the dust collector, for detaching the dust collector.

According to an air flow in the upright type vacuum cleaner structured as aforementioned, by an operation of an air sucking device provided in the main body 4, the polluted outside air with impurities is sucked in through an inlet provided on a lower surface of the sucking nozzle 2. The polluted air sucked in through the inlet of the sucking nozzle is entered into the dust collecting assembly 8 through the main body 4, and then discharged outside through an inside of the main body 4 after the impurities such as dust contained in the polluted air are filtered by a cyclone method or a filtering method using a filter in the dust collecting assembly.

In the related art upright vacuum cleaner configured as aforementioned, when a predetermined time is passed, the dust collecting assembly is filled with impurities and thus a user needs to empty the dust collecting assembly and put it back to the main body regularly.

However, the vacuum cleaner with the dust collecting assembly 8 detachably provided is prevented from losing air and from being overloaded while operating only if airtightness is maintained between the dust collecting assembly and the main body, in other words, if there is no air loss between the dust collecting assembly and the main body.

Therefore, development of a vacuum cleaner is requested for enabling to prevent the inferior mounting and to maintain airtightness between the dust collecting assembly and the main body.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner securing airtightness between a dust collecting assembly and a main body.

Another object of the present invention is to provide a vacuum cleaner enhancing efficiency of removing impurities such as dust contained in polluted air sucked in.

Another object of the present invention is to provide a vacuum cleaner for effectively separating the impurities and the clean air from which the impurities are removed when the impurities are collected by a cyclone method.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes a sucking nozzle for sucking in polluted air containing impurities by an operation of a motor, a dust collecting assembly separating impurities from the polluted air and collecting, and including a dust collecting container that has a dust collecting space formed in a cylindrical form therein, a polluted air inlet for sucking in polluted air, and a clean air outlet for discharging clean air separated from the impurities; and a main body including a dust collecting assembly receiving groove for receiving the dust collecting assembly, a polluted air outlet coupled with the dust collecting assembly inlet and discharging polluted air sucked in through the sucking nozzle to the dust collecting assembly, and a clean air inlet being provided on an inner wall of the dust collecting assembly receiving groove for facing the dust collecting assembly, sucking in air, and communicating with the dust collecting assembly outlet.

In this case, the dust collecting assembly is detached from a front of the main body. The clean air inlet of the main body is provided at a lower part of a rear inner wall of the dust collecting assembly receiving groove, and the dust collecting assembly outlet is provided at a rear lower side of the dust collecting container to be correspondent to the clean air inlet.

The dust collecting assembly further comprises an inner flow tube having a first end coupled with the dust collecting assembly outlet and a second end provided at a predetermined location on a center line of the dust collecting container so as to form a passage for discharging the clean air separated from the impurities from the dust collecting space.

The inner flow tube of the dust collecting assembly comprises: a first flow tube horizontally extended from the dust collecting assembly outlet to a center of the dust collecting container; a second flow tube extended upward from the center of the dust collecting container almost to a middle height of the dust collecting container; and a flow tube coupler for coupling the first flow tube and the second flow tube.

The flow tube coupler is curved or inclined for minimizing flow resistance of the clean air discharged from the inside of the dust collecting container.

The dust collecting assembly further comprises a lid for opening and closing an upper part of the dust collecting container. The dust collecting assembly further comprises a filtering device provided in the dust collecting assembly for filtering impurities. In this case, the filter is detachably coupled to the lid.

The filtering device comprises a filter formed in a hollow form for filtering microscopic dust, and a filter supporter for supporting the filter.

The dust collecting assembly inlet is provided at a predetermined location on a side of the dust collecting container for spiraling the polluted air sucked into the inside of the dust collecting container. The dust collecting assembly inlet includes a guide plate for guiding the polluted air in a tangential direction on an inner wall of the dust collecting container.

The dust collecting assembly further includes an anti rotation plate having a predetermined height and provided in the dust collecting container for preventing collected impurities from being rotated by spiraled air.

The dust collecting assembly further includes a shielding plate being coupled with a lower end of the filtering device and preventing the impurities collected at a lower part of the dust collecting container from being risen by the air flow. The shielding plate is formed in a skirt form.

The dust collecting assembly further includes a couple of projection projected from an outer wall of the dust collecting container and closely adhered to the dust collecting assembly receiving groove so as to maintain airtightness between the main body and the dust collecting container.

The main body further includes a receiving groove having a predetermined depth and being provided at a front end of the dust collecting assembly receiving groove for receiving the projection of the dust collecting assembly.

The main body further includes a packing member provided between the clean air inlet and the dust collecting assembly for maintaining airtightness between the clean air inlet and the dust collecting assembly outlet. In this case, the packing member includes a packing main body inserted and coupled to the clean air inlet, and an elastic member coupled with the packing main body and being closely adhered to the dust collecting assembly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
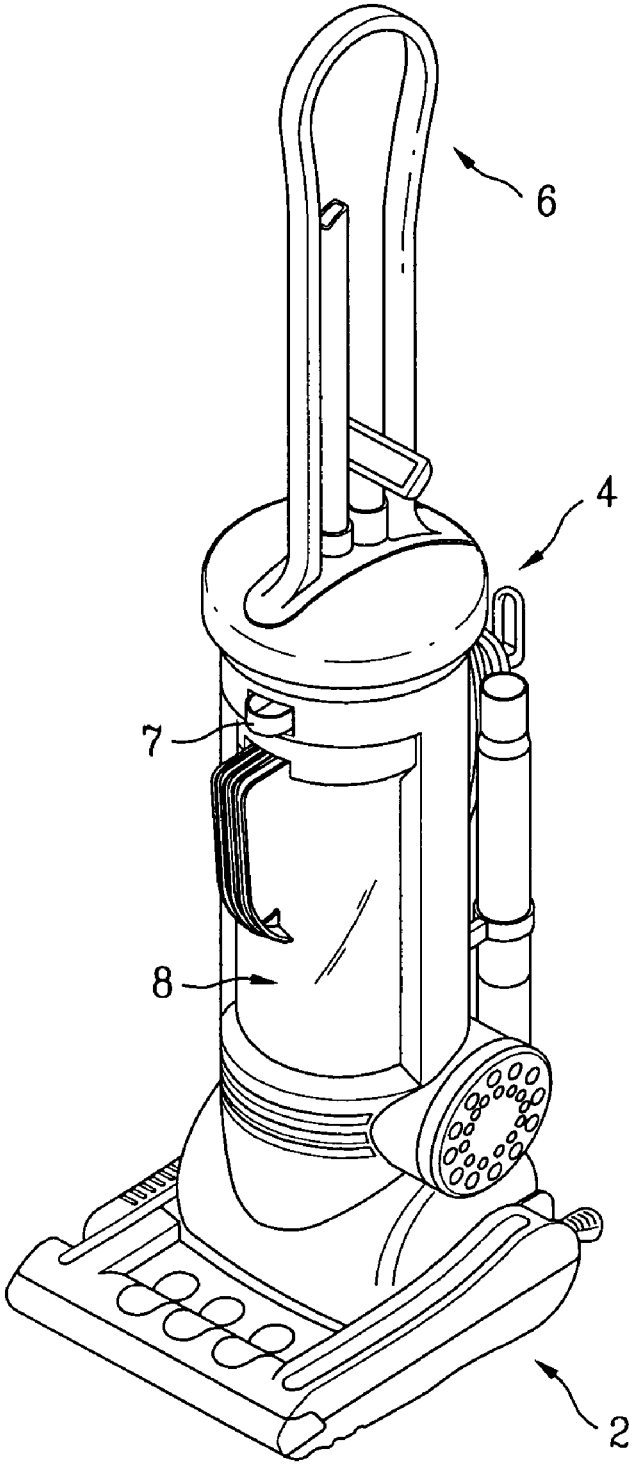
FIG. 1 Related Art
FIG. 1 illustrates a perspective view showing a related art upright vacuum cleaner.
Figure 2:
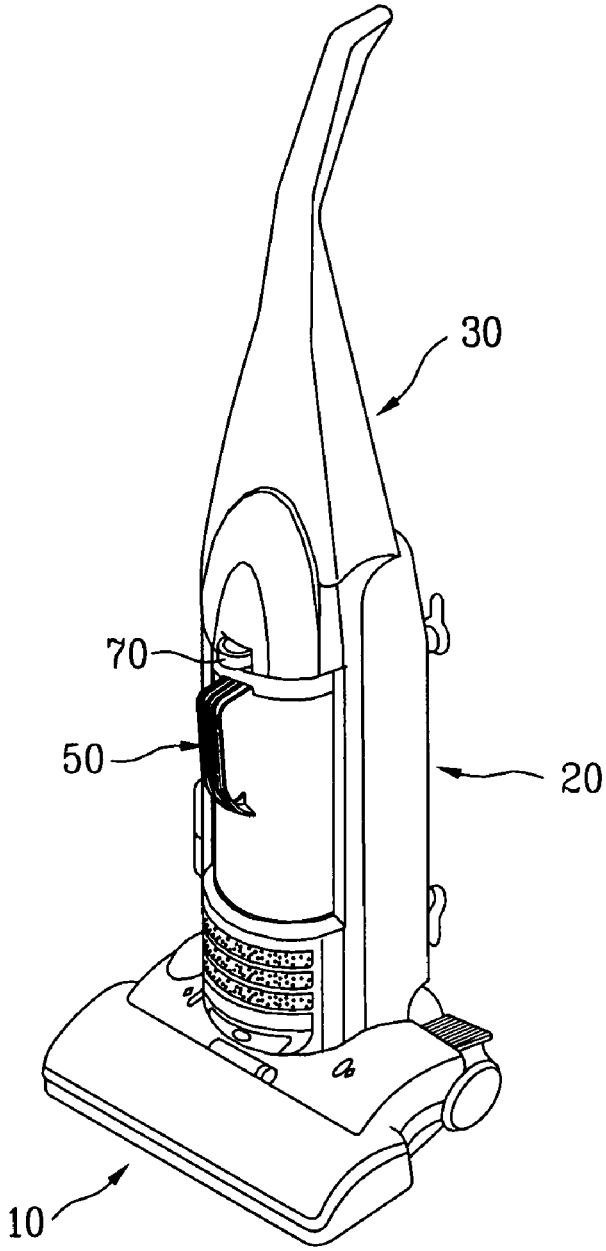
FIG. 2 illustrates a perspective view showing a vacuum cleaner in accordance with a preferred embodiment of the present invention.
Figure 3:
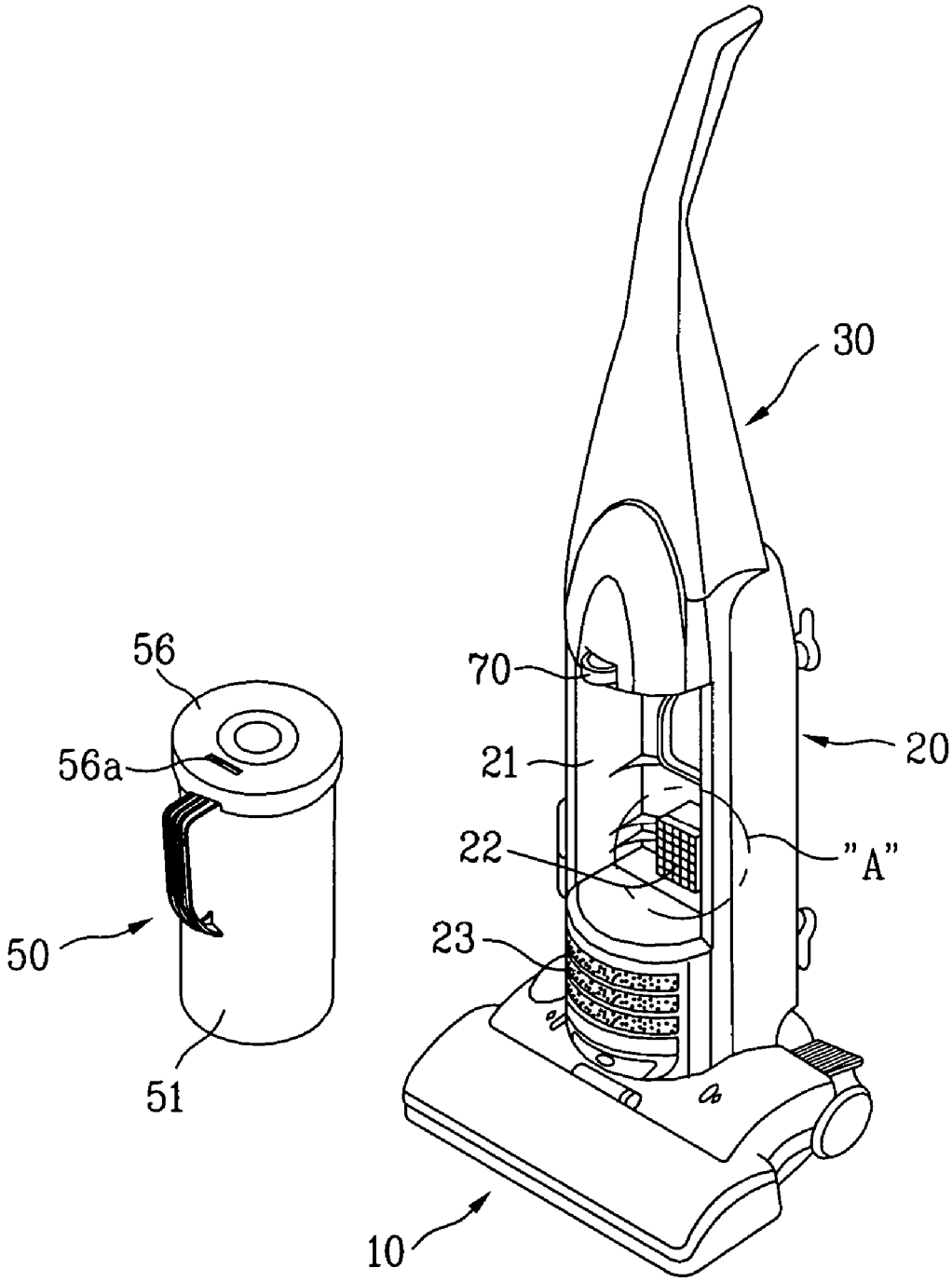
FIG. 3 illustrates a perspective view showing a dust collecting assembly being separated from a main body, the dust collecting assembly provided in a vacuum cleaner in accordance with the present invention.
Figure 4:
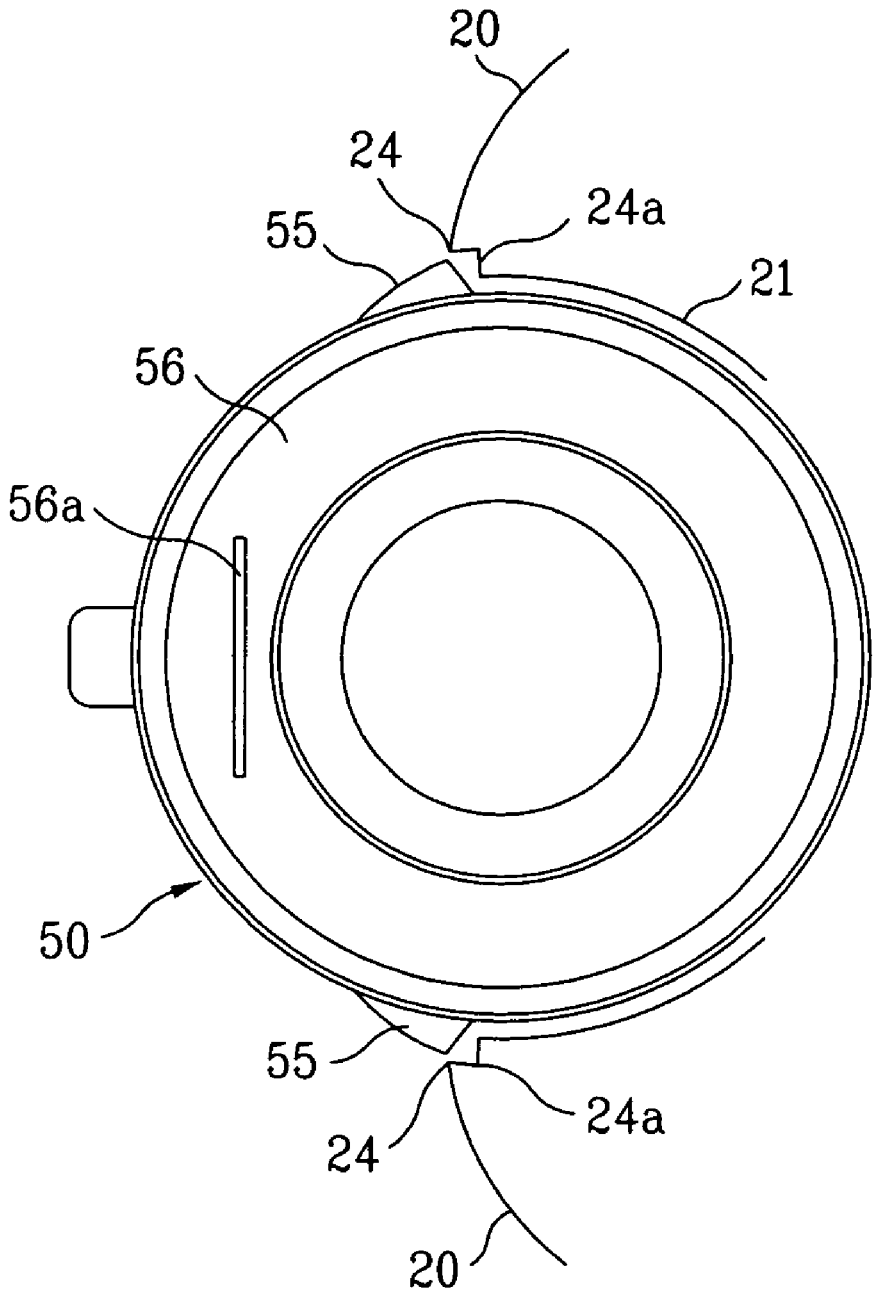
FIG. 4 illustrates a plan view of a dust collecting assembly before being installed to a main body, the dust collecting assembly provided a vacuum cleaner in accordance with the present invention.

Referring to FIGS. 2 to 4, a vacuum cleaner in accordance with the present invention includes a sucking nozzle 10 moving along a floor and sucking in air containing impurities, a main body 20 coupled with the cleaner head, and a handle 30 coupled with the main body.

The sucking nozzle 10 includes wheels (not shown) at a lower part thereof, moves along the floor in a state of being close thereto, and sucks in polluted air containing impurities from outside through a main inlet (not shown) provided at a lower part thereof.

It is desirable that an agitator is provided in the vicinity of the sucking nozzle 10. The agitator (not shown) is for separating the impurities such as dust stuck on the floor and sucking in the impurities along with outside air. The agitator includes a rotation axis horizontally provided in the inlet, and a rotation brush provided on an outer circumferential surface of the rotation axis. It is desirable that the rotation brush is provided in a spiral direction on the outer circumferential surface of the rotation axis.

The main body 20 is provided at an upper part of the sucking nozzle 10 to be rotatable in a predetermined range. In more detail, the main body 20 is hinge coupled with a rear top portion of the sucking nozzle 10.

Owing to the abovementioned structure, a user can clean the floor by holding the handle 30 and adjusting the angle of the main body 20 to a desired angle according to the height of the user or location to be cleaned.

An air sucking device (not shown) such as a motor generating air sucking force is provided in the main body 20, and the polluted outside air is sucked in through the inlet of the sucking nozzle 10 by an operation of the air sucking device. It is desirable that the air sucking device is coupled with the agitator of the sucking nozzle 10 for rotating the rotation axis of the agitator together with generating the sucking force for sucking the polluted air. The main body 20 desirably includes a sensor, particularly a temperature sensor (not shown) for sensing an overload of the air sucking device such as the motor.

In front of the main body 20, a dust collecting assembly receiving groove 21 receiving a dust collecting assembly 50 is provided for collecting impurities separated from the polluted air.

The dust collecting assembly receiving groove 21 provided on a front surface of the main body 20 is depressed inward, i.e., rearward so as to have a space for receiving the dust collecting assembly 50. In other words, the dust collecting assembly receiving groove 21 is sunken on the front surface of the main body to be correspondent to an exterior of the dust collecting assembly 50.

The dust collecting assembly 50 sucks in the polluted air through the main inlet of the sucking nozzle 10 and collects impurities separated from the polluted air. For that reason, the dust collecting assembly 50 includes a dust collecting container 51 formed in a cylindrical form and having a collecting space therein, an inlet 52 and an outlet 53 provided respectively at predetermined locations on a side thereof, and a dust collecting container handle 54 provided on a front outer wall of the dust collecting container.

In accordance with the present invention, the outlet 53 of the dust collecting assembly discharges clean air separated from the impurities such as dust to a rear side of the dust collecting assembly 50. Corresponding to the outlet, a clean air inlet 22 coupled with the outlet 53 of the dust collecting assembly is provided on a rear inner wall of the dust collecting assembly receiving groove 21. In other words, the clean air inlet 22 is provided on the rear inner wall of the dust collecting assembly receiving groove 21 to face the front.

The main body 20 includes a polluted air sucking pipe (not shown) guiding the polluted air sucked in through the main inlet of the sucking nozzle 10 to the dust collecting assembly inlet 52 and having a polluted air outlet coupled at an end thereof to the dust collecting assembly inlet 52, and a clean air discharging pipe (not shown) including the clean air inlet 22 provided at a first end thereof and a clean air exhausting port 23 provided at a second end thereof for discharging the clean air to the outside of the vacuum cleaner.

Although configured to pass through the main body 20, the polluted air sucking pipe may be configured to be exposed to an outside of the main body 20.

In this case, when the polluted air sucking pipe is exposed to the outside of the main body 20, it is desirable that the polluted air sucking pipe is made of a flexible material, has a predetermined portion detachably coupled to the main body 20 such that the user can clean a corner by using the polluted air sucking pipe.

Meanwhile, a fan (not shown) is provided at the air sucking device such as the motor. In the present invention, it is desirable that the fan is provided at the clean air discharging pipe for forcing an air flow in the vacuum cleaner.

Owing to the dust collecting assembly 50 and the main body 20 structured as abovementioned, when the dust collecting assembly 50 is fit in the dust collecting assembly receiving groove 21 of the main body, the clean air inlet 22 and the dust collecting assembly outlet 53 are more closely coupled by pushing force of the user. Furthermore, when carelessness or an unprofessional manipulation of the user caused a gap between the clean air inlet 22 and the dust collecting assembly outlet 53 and airtightness is not maintained there, since the air is sucked in from the clean air inlet 22 by the operation of the air sucking device, the dust collecting assembly is closely adhered to the rear side of the dust collecting assembly receiving groove 21 by air suction force, thereby coupling the clean air inlet 22 and the dust collecting assembly outlet 53 without any gap therebetween. Therefore, the airtighteness between the dust collecting assembly 50 and the main body 20 is maintained.

Owing to the abovementioned principle, maintaining airtightness between the dust collecting assembly and the main body is enabled by providing the clean air inlet 22 of the main body on the inner wall of the dust collecting assembly receiving groove 21 such that the clean air inlet 22 of the main body opposes to a direction of mounting the dust collecting assembly 50.

For securing the airtightness between the dust collecting assembly 50 and the main body 20, it is desirable that the dust collecting assembly 50 further includes a couple of projection 55 formed in a log form in up and down direction on the outer wall of the dust collecting container and closely adhered to a front end 24 of the dust collecting assembly receiving groove 21 during assembly of the dust collecting assembly.

In this case, corresponding to the couple of projection provided on the outer wall of the dust collecting container, it is desirable that a receiving groove 24*a* having a predetermined depth is provided at the front end 24 of the dust collecting assembly receiving groove, for receiving the couple of projection provided on the outer wall of the dust collecting container.

Owing to the projection 55 of the dust collecting assembly structured as abovementioned, the user learns that the outlet 53 of the dust collecting assembly is coupled to the clean air inlet 22 of the main body when the user pushes the dust collecting assembly 50 to a rear side thereof for fitting the dust collecting assembly 50 to the main body 20, and the couple of projection 55 is closely adhered to the receiving groove 24*a* provided at the front end 24 of the dust collecting assembly receiving groove. In addition, the airtightness between the dust collecting container and the main body is more effectively maintained.

The couple of projection 55 may be provided to be closely adhered to the inner walls on both sides of the dust collecting assembly receiving groove 21.

In addition, it is desirable that a packing member 60 is provided between the clean air inlet 22 and the dust collecting assembly outlet 53 for maintaining the airtightness therebetween.

Figure 5A:
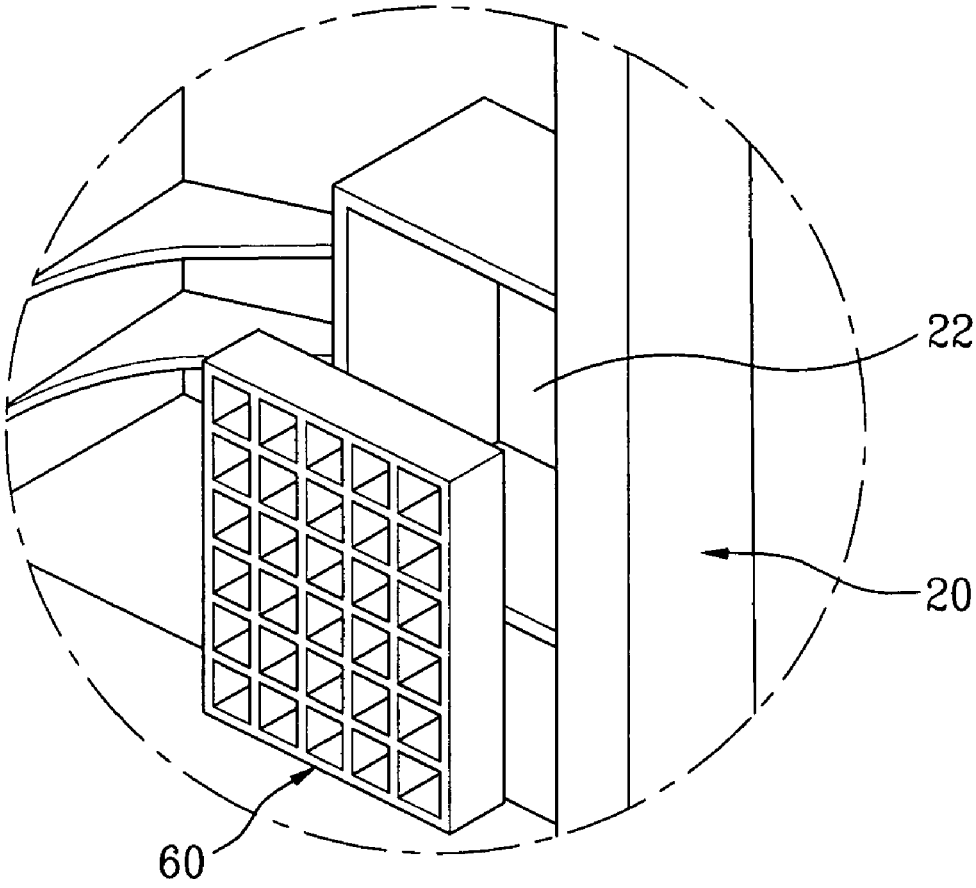
FIGS. 5A and 5B illustrate a perspective view of an amplified "A" section of FIG. 3 in accordance with another embodiment.
Figure 5B:
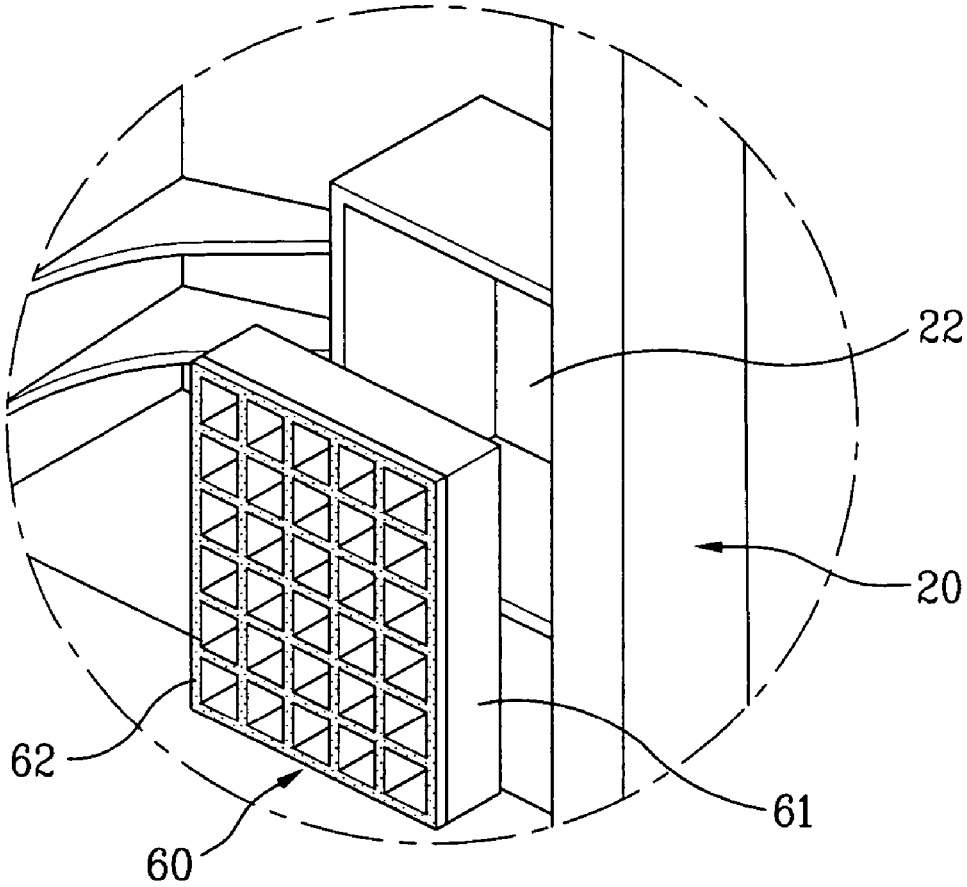
Figure 6:
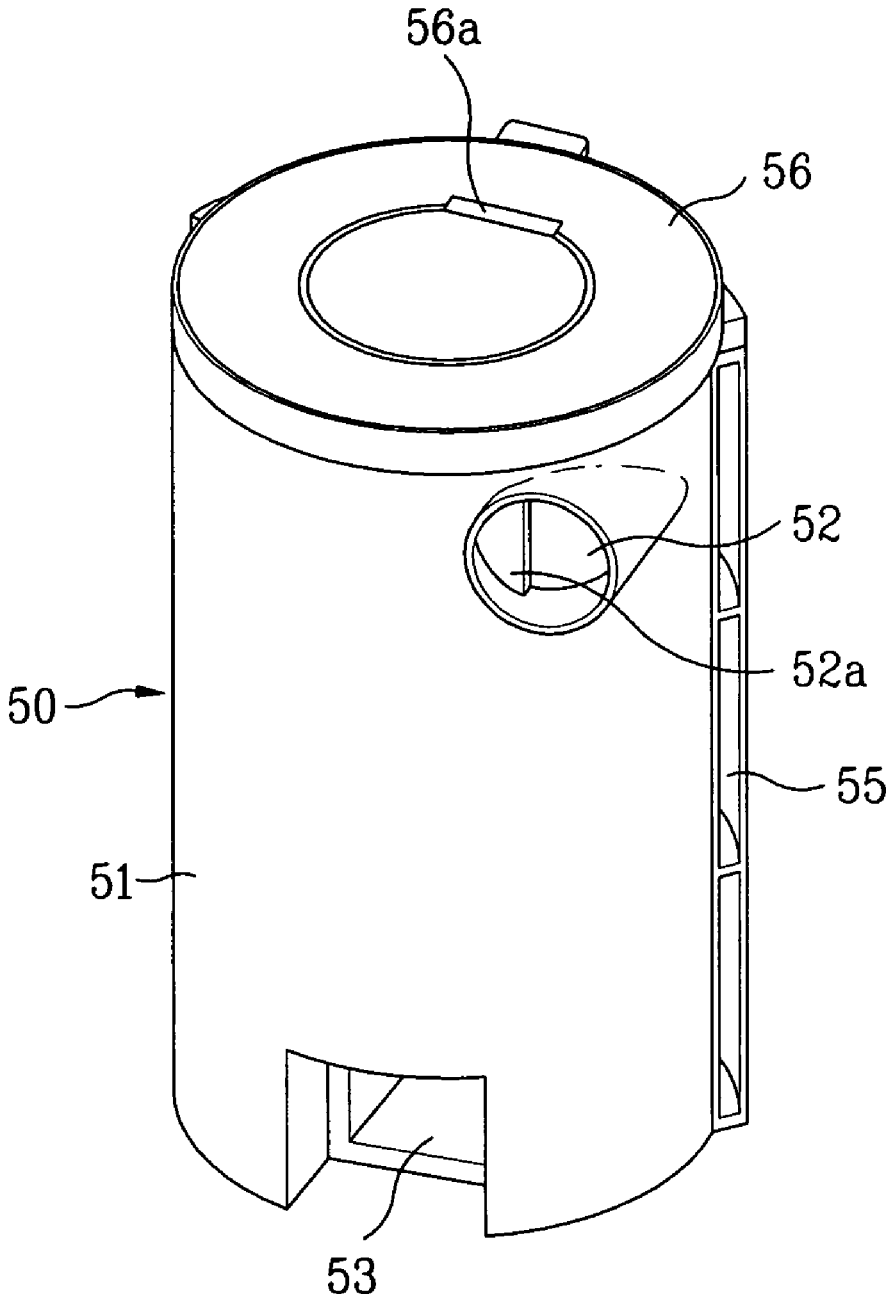
FIG. 6 illustrates a perspective view showing a preferred embodiment of a dust collecting assembly provided in a vacuum cleaner in accordance with the present invention.
Figure 7:
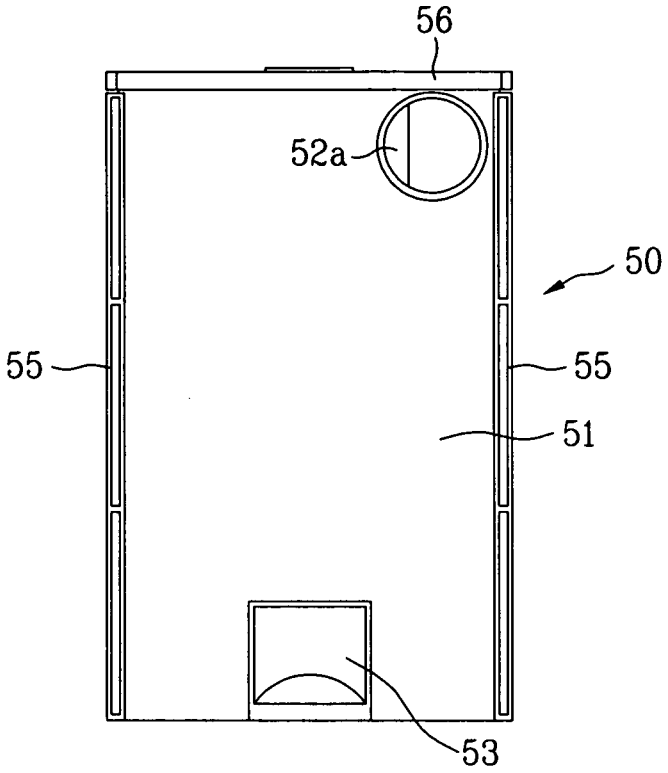
FIG. 7 illustrates a rear view showing the dust collecting assembly of FIG. 4.
Figure 8:
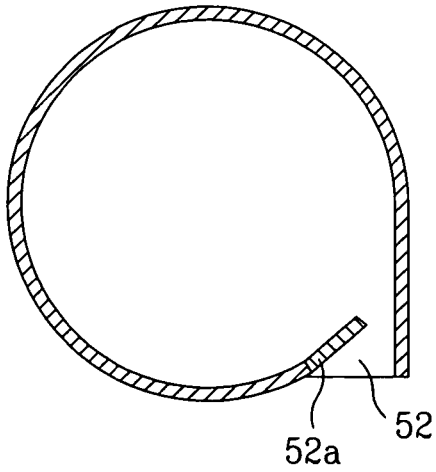
FIG. 8 illustrates a horizontal sectional view showing an inlet provided at the dust collecting assembly of FIG. 4.
Figure 9:
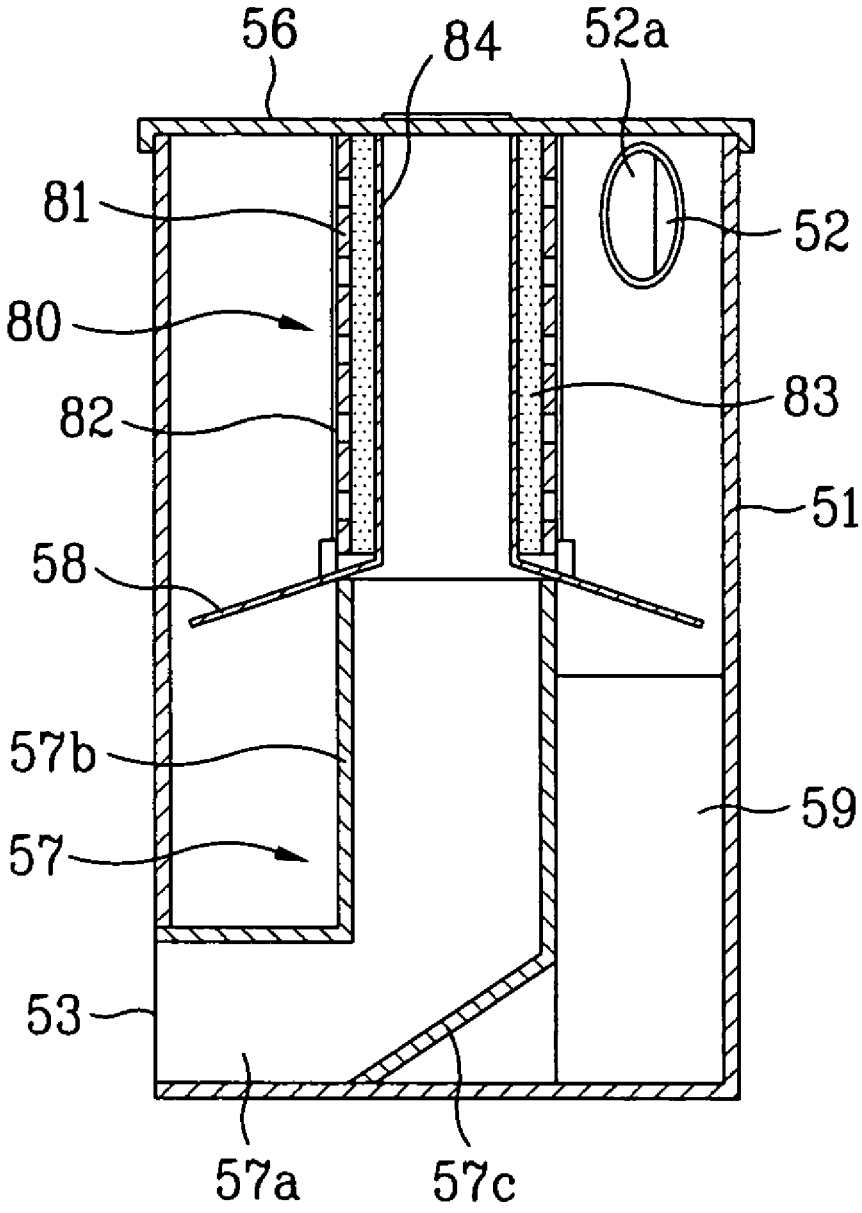
FIG. 9 illustrates a perpendicular sectional view showing the dust collecting assembly of FIG. 4.
Figure 10:
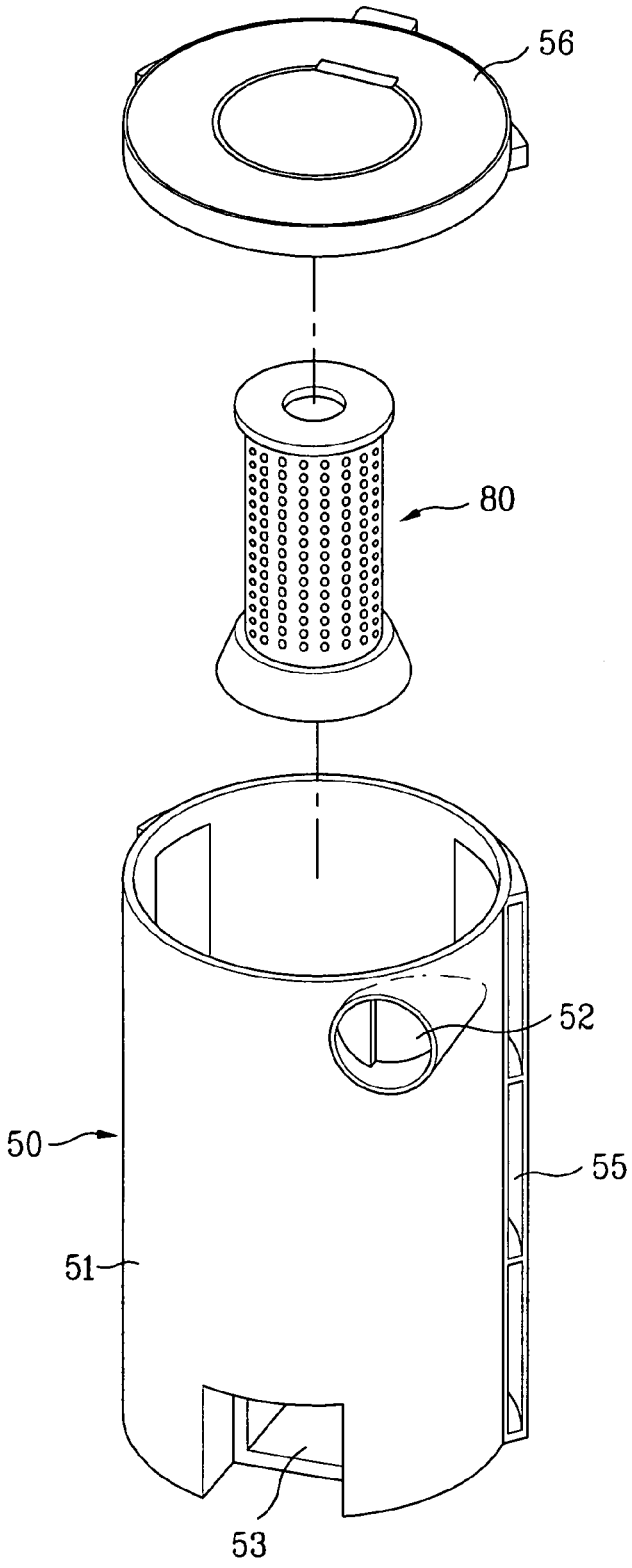
FIG. 10 illustrates an exploded perspective view showing the dust collecting assembly illustrated of FIG. 4.
Figure 11:
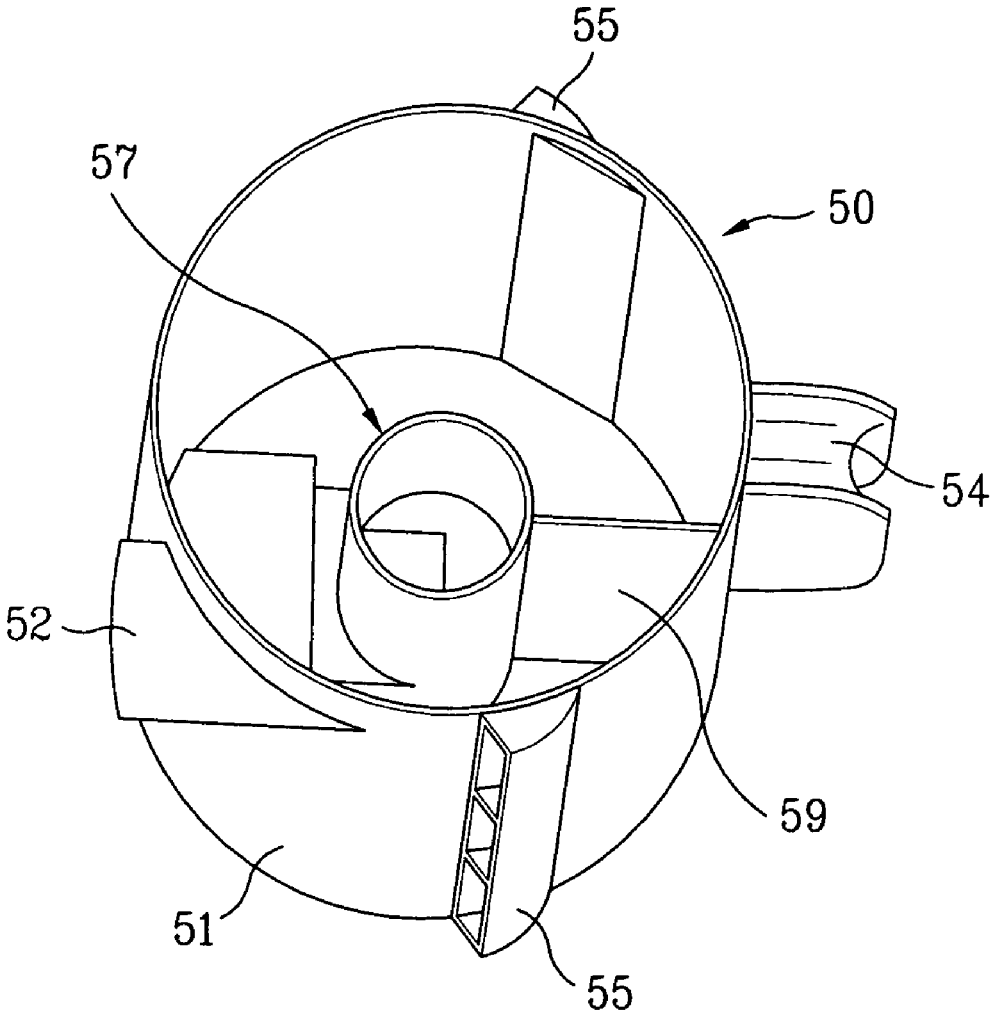
FIG. 11 illustrates a perspective view showing an upper part of the dust collecting assembly of FIG. 9.

Referring to FIGS. 5A and 5B, the packing member 60 is described in more detail below. The packing member 60 is provided at a front circumference of the clean air inlet 22 and formed in a mesh form for preventing impurities in large size from being entered into the clean air inlet 22.

In other words, when the dust collecting assembly 50 is provided at the main body 20, the airtightness between the clean air inlet 22 and the dust collecting assembly outlet 53 is maintained by closely adhering the packing member 60 to the dust collecting assembly outlet 53. In this case, it is desirable that the packing member 60 is made of a material such as rubber or silicon having elasticity.

Contrary to the abovementioned, the packing member 60 may include a packing main body 61 including synthetic resins, formed in a square frame form and inserted and coupled to the clean air inlet, and an elastic member 62 coupled to an inner side of the packing main body 61 and closely adhered to the dust collecting assembly outlet during assembly of the dust collecting assembly.

In this case, it is desirable that the elastic member 62 is formed in the mesh form for preventing the impurities in large size from being entered into the clean air inlet 22.

The dust collecting assembly 50 provided in the vacuum cleaner structured as abovementioned collects the impurities by using a cyclone method or a method of filtering impurities by means of a filtering device. The cyclone method and the filtering method by using the filtering device can be adopted at the same time as a method for separating impurities at the dust collecting assembly 50.

For attaching or detaching the dust collecting assembly 50 separating and collecting the impurities such as dust by using various methods abovementioned, a detachable device 70 is provided in front of the main body 20, more particularly, at an upper part of the dust collecting assembly receiving groove 21, and a groove 56*a* for catching the detachable device 70 is provided on an upper surface of the dust collecting assembly.

The detachable device 70 and the groove 56*a* structured as abovementioned fits the dust collecting assembly 50 to the main body 20 during assembly of the dust collecting assembly and releases the dust collecting assembly 50 during separation of the dust collecting assembly 50.

Hereinafter, as a preferred embodiment of the vacuum cleaner in accordance with the present invention, the dust collecting assembly for separating the impurities such as dust by the cyclone method firstly and separating microscopic dust by using the filtering device secondly will be described.

Referring to FIG. 6 to FIG. 11, the dust collecting assembly 50 includes the dust collecting container 51 having a dust collecting space formed in a cylindrical form therein for collecting the impurities separated from the impurities such as dust by the cyclone method, and a lid 56 detachably provided at the upper part of the dust collecting container 51 for opening and closing the upper part of the dust collecting container, and having a groove 56*a* catching the detachable device 70.

As aforementioned, the dust collecting assembly outlet 53 and the dust collecting assembly inlet 52 are provided at the dust collecting container 51. Particularly, the dust collecting assembly inlet 52 is provided at a predetermined location on the upper part of the dust collecting container such that the polluted air entered into the dust collecting space is spiraled in the dust collecting container 51.

In more detail, because the dust collecting assembly inlet 52 is provided to pass through a side of the dust collecting container 51 in a tangential direction, the polluted air is spiraled in the dust collecting container 51 and separated into the impurities such as dust and clean air by centrifugal force.

On an inner surface of the dust collecting assembly inlet 52, a guiding plate 52*a* is provided having a side portion of the dust collecting container being extended in the tangential direction so as to strengthen a spiral movement of the polluted air.

In accordance with the preferred embodiment, the dust collecting assembly outlet 53 is provided at a lower end of the rear side of the dust collecting container 51, and an inner flow tube 57 is provided in the dust collecting assembly, the inner flow tube having a first end coupled to the dust collecting assembly outlet 53 and a second end provided at a predetermined location on a center axis line of the dust collecting container 51 to form a passage for discharging the clean air, that is separated from the impurities, from the dust collecting space.

In more detail, the inner flow tube 57 includes a first flow tube 57*a* being horizontally extended from the dust collecting assembly outlet 53 to a bottom center of the dust collecting container 51, a second flow tube 57*b* extended upward from the bottom center of the dust collecting container 51 almost to a middle height of the dust collecting container, and a tube coupler 57*c* for coupling the first flow tube 57*a* and the second flow tube 57*b*. It is desirable that the flow tube coupler 57*c* is provided to be curved or to be inclined for minimizing flow resistance of the clean air discharged from the dust collecting space.

In addition to the configuration abovementioned, the dust collecting assembly 50 includes a filtering device 80 for removing microscopic dust contained in air before the clean air is discharged through the inner flow pipe 57, the air separated from the impurities firstly by the cyclone method in the dust collecting space.

Although provided between the lid 56 and an upper end of the second flow tube 57*b* for being coupled to either the lid 56 or the second flow tube 57*b*, the filtering device 80 is desirably provided to be separated from the dust collecting container 51 along with the lid when the lid being coupled with a lower surface of the lid 56 is opened.

In a detailed structure of the filtering device, the filtering device 80 includes a filter supporter 81 detachably coupled on the lower surface of the lid 56 and formed in a cylindrical form with a plurality of pass through holes, a first filter 82 provided on an outer surface of the filter supporter and formed in a stick form, and a second filter 83 provided on an inner circumferential surface of the filter supporter 81.

The filter supporter 81 may be made of synthetic reins by an injection molding, and the first filter 82 is made of a thin fabric or a synthetic resin such as a film, and the second filter 83 is made of a sponge having a predetermined thickness.

On the upper outer circumferential surface of the filter supporter 81 structured as abovementioned, a projection (not shown) is radially projected, and a groove (not shown) for catching the projection is provided on the lower surface of the lid 56. The projection is inserted and caught in the groove to be provided at the lid. It is desirable that a supplementary supporter 84 formed in the cylindrical form is further provided on the inner surface of the second filter 83 for supporting the second filter.

Owing to the structure abovementioned, the polluted air entered into the dust collecting container 51 is cleaned firstly by separating impurities in heavy weight and in the large size according to the cyclone principle, and cleaned secondly by passing through the filtering device 80 for filtering the microscopic dust, and then discharged through a clean air discharging pipe of the main body having the inner flow tube 57 and the fan.

It is obvious that the microscopic dust is additionally filtered before the air is discharged to outside of the vacuum cleaner by providing a third filter (not shown) at a predetermined location of the clean air discharging pipe. The filters may include HEPA filters.

However, since the dust collecting assembly 50 with the abovementioned structure separates and collects impurities such as dust according to the cyclone principle, there is a problem that the impurities such as dust piled up at a lower part of the dust collecting container 51 is risen by the spiraled air in a process of spiral flow of the polluted air entered into the dust collecting assembly, and thereby lowering dust collecting efficiency.

Therefore, the dust collecting assembly 50 provided in the vacuum cleaner in accordance with the present invention further includes a shielding plate 58 formed in a round form and coupled with a lower end of the filtering device 80, or at least one anti rotation plate 59 radially provided at the lower part of the dust collecting container 51.

In this instance, it is desirable that the shielding plate 58 is formed in a skirt form and extended toward a lower part thereof and the lower surface of the shielding plate 58 is closely adhered to the upper end of the inner flow tube 57.

It is obvious that the shielding plate may include a coupled of semicircle plate that is formed in a semicircle form, and opened or closed by being rotated upward.

The anti rotation plate 59 has a first end being coupled to an outer wall of the inner flow tube, a second end being coupled to an inner wall of the dust collecting container, and a height close to the height of the second flow tube 57*b*.

In the vacuum cleaner in accordance with the present invention, the shielding plate 58 and the anti rotation plate 59 structured as abovementioned are both provided in the dust collecting container 51, or either one is provided.

Movement of the vacuum cleaner structured as abovementioned in accordance with the present invention will be described.

First, when the operation of the vacuum cleaner is started, by the operation of the motor in the main body 20, the brush provided at the sucking nozzle 10 is rotated for separating the dust stuck on the floor, and the fan coupled to the motor is rotated for sucking in impurities such as dust through the main inlet of the sucking nozzle 10.

The polluted air sucked in through the main inlet is entered into the dust collecting assembly 50 through the polluted air sucking pipe of the main body 20.

The air entered into the inside of the dust collecting assembly 50 is cyclone flowed, thereby separating the impurities such as dust from the polluted air and collecting the impurities at the lower part of the dust collecting container 51.

In this instance, owing to the anti rotation plate 59 and the shielding plate 58, the impurities collected at the lower part of the dust collecting container 51 are prevented from being rotated by the spiraled air formed in the dust collecting container or being risen to the upper space of the dust collecting container 51.

Owing to the abovementioned cyclone principle, the air separated from the impurities such as dust is passed through the first filter 82 and the second filter 83, and then entered into the inner flow tube 57.

The air entered into the inner flow tube 57 is discharged through the dust collecting assembly outlet 53 and entered into the clean air discharging pipe having the clean air inlet 22. The air entered into the clean air discharging pipe is passed through the fan and discharged outside of the vacuum cleaner through the clean air exhausting port 23.

Although the upright type vacuum cleaner having a main body coupled with the upper part of the cleaner head is mainly discussed in the preferred embodiment of the present invention, the structure is not limited to the present invention, but can be applied to a canister type vacuum cleaner having a separate cleaner head and main body.

The effect of the vacuum cleaner is summarized as follows. First, according to the vacuum cleaner in accordance with the present invention, the clean air inlet is provided on the rear inner wall of the dust collecting assembly receiving groove to face the front thereof. Therefore, even though carelessness of an unprofessional manipulation of the user caused a gap between the clean air inlet and the dust collecting assembly outlet during assembly of the dust collecting assembly, the airtighteness between the dust collecting assembly and the main body is maintained because air is sucked in from the clean air inlet by the operation of the air sucking device and thus the dust collecting assembly is closely adhered to the rear side of the dust collecting assembly receiving groove by air suction force.

Second, according to the vacuum cleaner in accordance with the present invention, owing to the couple of projection formed in a long form in a perpendicular direction on the side of the dust collecting assembly 50 and the packing member provided between the clean air inlet and the dust collecting assembly outlet, the airtightness between the dust collecting assembly and the main body is maintained, thereby preventing the air loss.

Third, according to the vacuum cleaner in accordance with the present invention, since the guiding plate provided at the dust collecting assembly inlet guides the polluted air entered into the dust collecting assembly in a tangential direction on the inner wall of the dust collecting assembly, more strengthened spiral flow is generated, thereby improving the dust collecting efficiency and preventing the polluted air entered into the dust collecting assembly from directly shocking the filtering device.

Fourth, according to the vacuum cleaner in accordance with the present invention, since the shielding plate and the anti rotation plate provided in the dust collecting assembly prevents the impurities such as dust collected at the lower part of the dust collecting assembly from being rotated or being risen by the spiraled air, the dust collecting efficiency is increased.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner, comprising:

a suction nozzle that draws in polluted air through operation of a motor;

a dust collecting assembly that separates and collects impurities from the polluted air, wherein the dust collecting assembly includes:

a dust collecting container that has a dust collecting space formed therein;

a polluted air inlet that directs polluted air into the dust collecting container;

a clean air outlet that directs clean air out of the dust collecting container;

an anti-rotation plate provided in the dust collecting container, wherein the anti-rotation plate extends upward from a lower portion of the dust collecting container so as to prevent impurities collected in the dust collecting container from being rotated by air flowing in a spiral in the dust collecting container; and a filtering device positioned in the dust collecting container, wherein the filtering device filters impurities from the polluted air;

a main body, including:

a dust collecting assembly receiving groove that receives the dust collecting assembly;

a polluted air outlet coupled to the polluted air inlet of the dust collecting assembly, wherein the polluted air outlet discharges polluted air drawn in through the suction nozzle into the dust collecting assembly; and a clean air inlet provided on an inner rear wall of the dust collecting assembly receiving groove, facing a rear wall of the dust collecting assembly, wherein the clean air inlet is in communication with the clean air outlet of the dust collecting assembly so as to receive clean air discharged from the dust collecting assembly;

an inner flow tube coupled to the clean air outlet of the dust collecting assembly and extending toward the filtering device so as to form a passage through which clean air is discharged from the filter device to the clean air outlet of the dust collecting assembly, wherein the anti-rotation plate extends between an outer wall of the inner flow tube and an inner wall of the dust collecting container; and a packing member provided between the clean air inlet of the main body and the clean air outlet of the dust collecting assembly so as to maintain airtightness therebetween, wherein the packing member comprises:

a packing body portion inserted in and coupled to the clean air inlet of the main body; and an elastic member coupled to an inner side of the packing body and closely adhered to the clean air outlet of the dust collecting assembly, wherein the elastic member is configured to filter impurities from air passing therethrough.

2. The vacuum cleaner as claimed in claim 1, wherein the inner flow tube includes a first portion coupled to the clean air outlet of the dust collecting assembly, and a second portion that extends along a center line of the dust collecting container so as to form a passage through which clean air is discharged from the dust collecting space.

3. The vacuum cleaner as claimed in claim 2, wherein the inner flow tube comprises:

a first flow tube that extends horizontally from the clean air outlet of the dust collecting assembly outlet to a lower central portion of the dust collecting container;

a second flow tube that extends upward from the lower central portion of the dust collecting container to a predetermined height within the dust collecting container; and a flow tube coupler that extends between the first flow tube and the second flow tube so as to connect the first and second flow tubes.

4. The vacuum cleaner as claimed in claim 3, wherein the flow tube coupler is curved or inclined so as to minimize flow resistance of the clean air discharged thereto from the dust collecting container.

5. The vacuum cleaner as claimed in claim 1, wherein the dust collecting assembly further comprises a lid that opens and closes an upper portion of the dust collecting container.

6. The vacuum cleaner as claimed in claim 5, wherein the filtering device is detachably coupled to the lid so as to filter impurities from the polluted air.

7. The vacuum cleaner as claimed in claim 6, wherein the dust collecting assembly further comprises a shielding plate coupled to a lower end of the filtering device, wherein the shielding plate prevents impurities collected at a lower portion of the dust collecting container from being drawn upwards by air flow in the dust collecting container.

8. The vacuum cleaner as claimed in claim 7, wherein the shielding plate is formed in a skirt form.

9. The vacuum cleaner as claimed in claim 5, wherein the polluted air inlet of the dust collecting assembly is provided at a predetermined position on a side of the dust collecting container such that polluted air, drawn into the dust collecting container through the polluted air inlet, forms a spiral flow within the dust collecting container.

10. The vacuum cleaner as claimed in claim 1, wherein the filtering device comprises:

a hollow filter that filters microscopic dust from the polluted air; and a filter supporter that supports the filter.

11. The vacuum cleaner as claimed in claim 10, wherein the polluted air inlet of the dust collecting assembly comprises a guide plate that guides polluted air in a tangential direction along an inner wall of the dust collecting container.

12. The vacuum cleaner as claimed in claim 1, wherein the dust collecting assembly further comprises a pair of projections that project outward from an outer wall of the dust collecting container and are closely fitted to the dust collecting assembly receiving groove so as to position and secure the dust collecting container to the main body.

13. The vacuum cleaner as claimed in claim 12, wherein the main body further comprises a pair of projection receiving grooves each having a predetermined depth and being provided at a front end of the dust collecting assembly receiving groove so as to receive the pair of projections of the dust collecting assembly.

14. The vacuum cleaner as claimed in claim 1, wherein the packing member is formed in a mesh form so as to filter impurities from air passing therethrough.

* * * * *